US007257968B1

(12) United States Patent
Aloy Font

(10) Patent No.: US 7,257,968 B1
(45) Date of Patent: Aug. 21, 2007

(54) CLEANING FABRIC

(76) Inventor: Juan Manuel Aloy Font, Ctra, Sant Antoni a Sant Pere, Km.1, 08459 Sant Pere de Vilamajor, Barcelona (ES)

( * ) Notice: Subject to any disclaimer, the term of this patent is extended or adjusted under 35 U.S.C. 154(b) by 0 days.

(21) Appl. No.: 11/605,094

(22) Filed: Nov. 28, 2006

(30) Foreign Application Priority Data

Jan. 19, 2006 (ES) ..... 200600131 U

(51) Int. Cl.
*D04B 11/08* (2006.01)

(52) U.S. Cl. ..... 66/194; 66/195

(58) Field of Classification Search ..... 66/191–195, 66/202

See application file for complete search history.

(56) References Cited

U.S. PATENT DOCUMENTS 3,879,961 A * 4/1975 Greczin ..... 66/9 A
4,275,574 A * 6/1981 Muns ..... 66/163
5,065,600 A * 11/1991 Byles ..... 66/193
5,271,983 A * 12/1993 Ise et al. ..... 428/92
5,317,886 A * 6/1994 Prahl ..... 66/192
5,503,892 A * 4/1996 Callaway ..... 428/100
5,520,022 A * 5/1996 Callaway ..... 66/194
5,526,656 A * 6/1996 Conroy et al. ..... 66/193
5,916,273 A * 6/1999 Hepfinger ..... 66/194

* cited by examiner

*Primary Examiner*—Danny Worrell
(74) *Attorney, Agent, or Firm*—Dann, Dorfman, Herrell and Skillman; Henry H. Skillman

(57) ABSTRACT

Ecological cleaning fabric comprising polyester-based microfiber comprising a warp-bent fabric having polyester-based yarn in the base with multi-filter loops, preferably including polyester textile fiber.

7 Claims, 2 Drawing Sheets

CLEANING FABRIC

OBJECT OF THE INVENTION

The present invention relates to a cleaning fabric of the ecological type.

BACKGROUND OF THE INVENTION

Various different types of fabric are currently known for manufacturing cleaning cloths.

Traditionally, people have used cloths made from different cotton fabrics or other natural fibres that soak up water very well, but which require the use of detergents and other products in order to efficiently clean incrusted dirt such as grease and other contaminants. These cloths made from natural fibres take the form of loop fabric to increase the water absorption capacity, or a smoother, thinner fabric for use in drying.

Lately, new synthetic fibres have emerged, which allow common cleaning using fewer detergent products. These fibres are preferably polyester-based microfibre and their microfibre makeup means that a fabric or cloth made with a yarn of this type can collect more dirt and dust in a single wipe of the surface to be cleaned. Such is the efficiency of these synthetic fibres that cloths made from these fibres are usually called "ecological cloths", because in many cases they do not require the use of detergents and cleaning substances, as they can be used dry or simply with water.

However, the polyester microfibre fabrics with which these cloths are made are manufactured as fine warps to make them lighter and they do not present such a great level of absorption as cloths made from natural fibres.

SUMMARY OF THE INVENTION

The cleaning fabric that is the object of this invention presents a number of technical features that make it particularly appropriate for cleaning all types of surfaces, having a great capacity for absorbing liquids and cleaning power.

The fabric of the invention consists of a warp knit fabric manufactured on a Ketten-type machine, preferably with three guide bars. The fabric consists of a snag-resistant warp base onto which long loops are lapped, the warp yarns being of a polyester base and the loop yarns being of a multifibre, preferably polyester.

This makeup allows it to be used on dirty surfaces, whether dusty or greasy, tiles, furniture, glass, electrical appliances, cars, metals, leather, plastic, silver and other metals.

The presence of the loops allows a greater absorption of liquids and non-dry dirt, such as grease, achieving more than twice the absorption of the fabric of a conventional cloth. The loops also make it possible to reach more easily into the corners of surfaces. In order to clean surfaces with incrusted dirt and stubborn grease stains, the fabric of the invention can be dampened with cold or warm water, although this is not necessary.

The different yarns used in the warp and in the loops can be made from different types of polyester textile fibre, comprising the materials PES TEX 45/36 SM, PES TEX 95/216 SM, PES TEX 65/204 SM or PES TEX 67/36 SM.

The fabric can be used for cloths of various sizes and other configurations. It is simple to care for and can even be machine-washed at high temperature without losing its consistency or properties.

These and other characteristics define the fabric of the present invention.

DESCRIPTION OF THE PREFERRED EMBODIMENT

Figure 1:
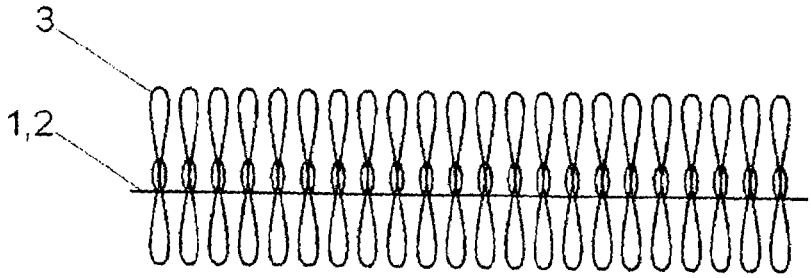
FIG. 1 shows a cross-sectional view of a portion of the fabric.
Figure 2:
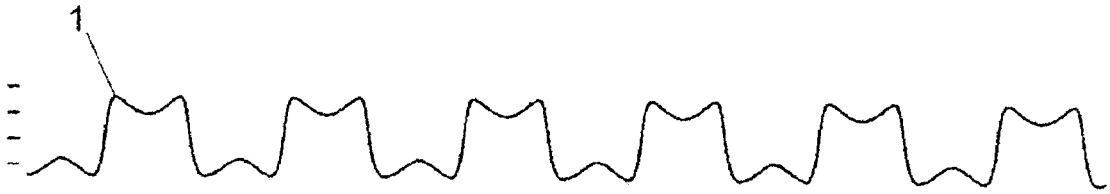
FIG. 2 shows a graphic representation of the knit of the first yarn of the base warp.
Figure 3:
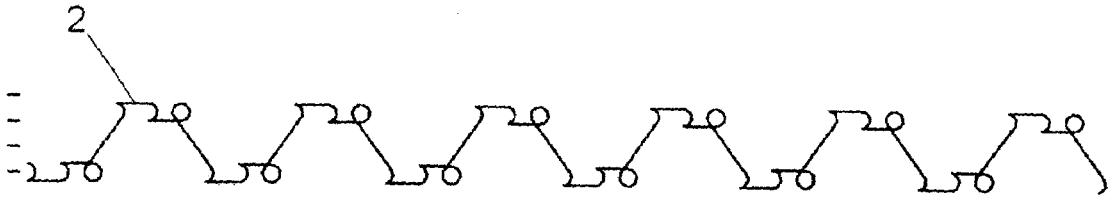
FIG. 3 shows a graphic representation of the knit of the second yarn of the base warp.
Figure 4:
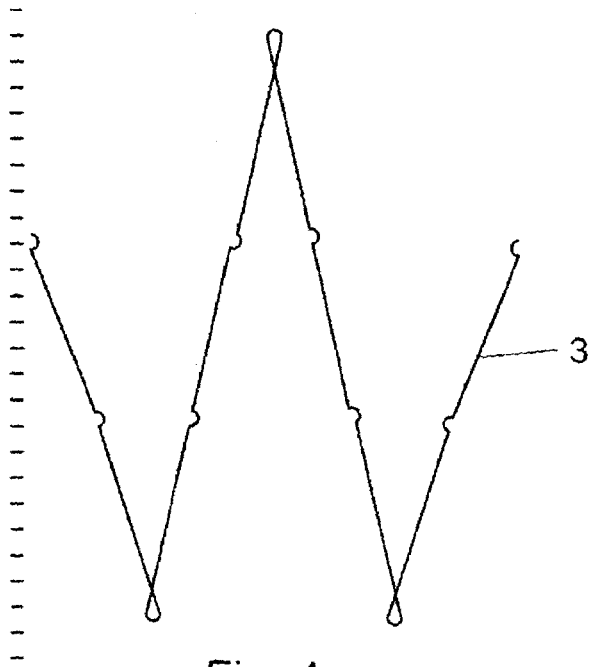
FIG. 4 shows a graphic representation of the knit of the third yarn, which forms the loops.
Figure 5:
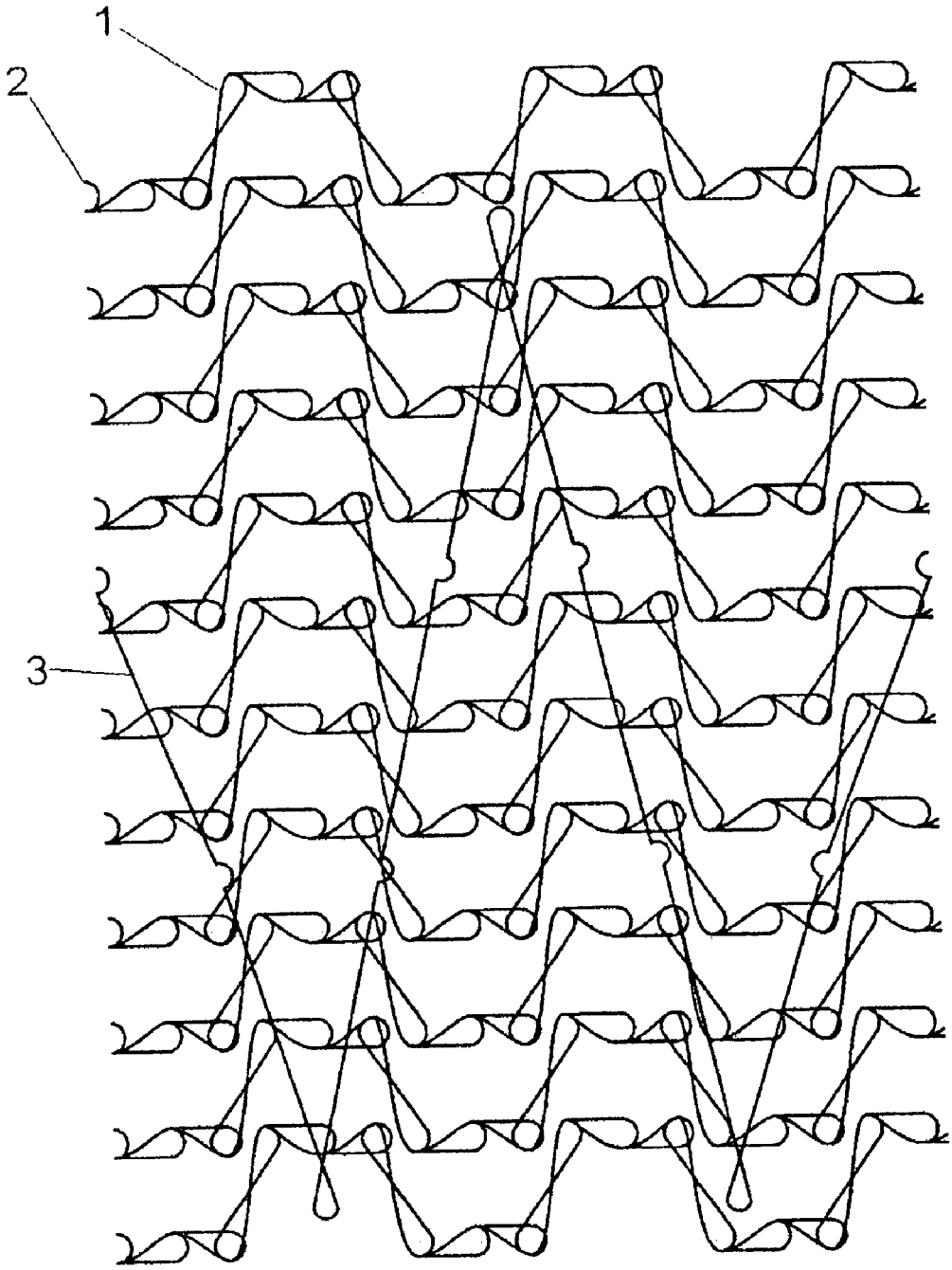
FIG. 5 is a diagram of the knitted structure shown in FIG. 1.

As can be observed in the aforementioned figures, the cleaning fabric consists of a warp knit manufactured on a Ketten-type machine, with a snag-resistant base onto which long loops are lapped.

Yarn (1) is a polyester textile fibre PES TEX 45/36 SM. Yarn (2) is a polyester textile fibre PES TEX 95/216 SM. Yarn (3) is a polyester textile fibre PES TEX 65/204 SM.

The warp knit of the three yarns comprises yarn (1) with 0-0/1-1/0-0/3-3/2-2/3-3// lapping; yarn (2) with 1-0/0-1/1-0/2-3/3-2/2-3// lapping; and yarn (3) with 14-13/8-7/2-1/7-8/13-14/20-21// lapping and a threading pattern for yarn (1) of 1 full, 1 empty, 1 full, 1 empty; for yarn (2) 1 empty, 1 full, 1 empty, 1 full; and for yarn (3) 1 double, 1 empty, 1 double, 1 empty.

Having adequately described the nature of the invention and a preferred embodiment thereof, it must be noted that the materials, form, size and layout of the described elements may be modified, provided that this does not involve altering the essential characteristics of the invention described in the following claims.

The invention claimed is:

1. Cleaning fabric, comprising a warp knit fabric, with a snag-resistant base having first and second yarns onto which long loops of a third yarn are lapped, said first and second yarns of the base being made of polyester and said third yarns of the loops being made of multifibre, wherein the base comprises said first yarn with 0-0/1-1/0-0/3-3/2-2/3-3// lapping, said second yarn with 1-0/0-1/1-0/2-3/3-2/2-3// lapping, and said third yarn with 14-13/8-7/2-1/7-8/13-14/20-21// lapping and a threading pattern for said first yarn (1) of 1 full, 1 empty, 1 full, 1 empty; for said second yarn 1 empty, 1 full, 1 empty, 1 full and for said third yarn 1 double, 1 empty, 1 double, 1 empty.

2. Fabric, according to claim 1, characterized in that said third yarns of the loops are made of polyester.

3. Fabric, according to claim 1, characterized in that said second yarn is a polyester textile fibre PES TEX 45/36 SM.

4. Fabric, according to claim 1, characterized in that said second yarn is a polyester textile fibre PES TEX 95/216 SM.

5. Fabric, according to claim 1, characterized in that said third yarn is a polyester textile fibre PES TEX 65/204 SM.

6. Fabric, according to claim 1, characterized in that said second yarn is a polyester textile fibre PES TEX 67/36 SM.

7. Fabric according to claim 2 characterized in that yarns are a polyester fiber PES TEX 65/204 SM.

* * * * *